US006736487B2

(12) United States Patent
Daniels

(10) Patent No.: US 6,736,487 B2
(45) Date of Patent: May 18, 2004

(54) PRINTER CARTRIDGE AND METHOD OF MAKING OR REFURBISHING

(75) Inventor: Matthew Daniels, Pittsboro, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 10/065,227

(22) Filed: Sep. 26, 2002

(65) Prior Publication Data

US 2004/0061742 A1 Apr. 1, 2004

(51) Int. Cl.[7] ..... B49J 2/94
(52) U.S. Cl. ..... 347/50
(58) Field of Search ..... 347/19, 37, 50; 156/344; 399/90

(56) References Cited

U.S. PATENT DOCUMENTS 5,525,183 A * 6/1996 Baley ..... 156/344
5,634,175 A * 5/1997 Michlin et al. ..... 399/90
6,161,915 A * 12/2000 Bolash et al. ..... 347/19
6,260,942 B1 * 7/2001 Ahne et al. ..... 347/19

* cited by examiner

*Primary Examiner*—Anh T.N. Vo
(74) *Attorney, Agent, or Firm*—Charles L. Moore, Jr.; Moore & Van Allen, PLLC

(57) ABSTRACT

A printer cartridge and method of making or refurbishing a printer cartridge are disclosed. The printer cartridge may include a first cartridge subassembly attached to a second cartridge subassembly. The first cartridge subassembly may include a first conductive terminal and the second cartridge subassembly may include a second conductive terminal that is normally in electrical contact with the first conductive terminal when the first and second subassemblies are assembled. An external access may be provided to the first conductive terminal in the event the first conductive terminal is inaccessible after assembling the printer cartridge.

19 Claims, 2 Drawing Sheets

PRINTER CARTRIDGE AND METHOD OF MAKING OR REFURBISHING

BACKGROUND OF THE INVENTION

Field of the Invention

The present invention relates to computer printers and the like and more particularly to a printer cartridge, refurbished or remade printer cartridge or the like and a method of making or refurbishing printer cartridges or similar devices.

Printer cartridges, such as laser printer cartridges or the like may be made or refurbished by filling the cartridges with toner, ink or the like and replacing any damaged or worn parts. To refurbish and refill a cartridge, the cartridge may generally need to be disassembled and reassembled. Component parts, such as electrical contacts, terminals or the like, can be damaged or misaligned during the refurbishing process. Electrical contacts on different components of the cartridge may therefore not make proper contact with one another when the cartridge is reassembled and the cartridge may malfunction or not be able to provide some features, such as a message when toner level is low or the like. Some of the electrical contacts may be internal to the cartridge on some types of cartridges when the cartridges are assembled. This prevents access to the contacts or terminals for testing to confirm whether the contacts or terminals are properly making contact after assembling the cartridge.

Accordingly, there is a need to provide a method to make or refurbish a printer cartridge that permits access to any internal contacts or terminals for testing of the electrical contact or connection. There is also a need to provide a printer cartridge or refurbished printer cartridge that includes access to any internal contacts or terminals for testing.

SUMMARY OF INVENTION

In accordance with an embodiment of the present invention, a method of making or refurbishing a printer cartridge may include assembling a first cartridge subassembly and a second cartridge subassembly. The first cartridge subassembly may include a first conductive terminal and the second cartridge subassembly may include a second conductive terminal that is normally in electrical contact with the first conductive terminal when the first and second subassemblies are assembled. The method may also include providing an external access to the first conductive terminal, the first conductive terminal being inaccessible after assembling the printer cartridge.

In accordance with another embodiment of the present invention, a method of making or refurbishing a printer cartridge may include attaching a conductive strip or the like on one of a first printer cartridge subassembly or a second printer cartridge subassembly. The first cartridge subassembly may include at least a first conductive terminal and the second cartridge subassembly may include at least a second conductive terminal that normally electrically contacts the at least first conductive terminal when the first and second cartridge subassemblies are assembled. The at least first conductive terminal may be inaccessible and the at least second conductive terminal may be accessible when the first and second cartridge subassemblies are assembled. The method may include coupling a first portion of the conductive strip to the at least first conductive terminal when assembling the first and second cartridge subassemblies. The method may also include exposing a second portion of the conductive strip external to the first and second cartridge subassemblies when assembling the first and second cartridge subassemblies.

In accordance with a further embodiment of the present invention, a printer cartridge may include a first cartridge subassembly and a second cartridge subassembly attached to the first cartridge subassembly. The first cartridge subassembly may include a first conductive terminal and the second cartridge subassembly may include a second conductive terminal that is normally in electrical contact with the first conductive terminal when the first and second subassemblies are attached. An external access may be provided to the first conductive terminal, the first conductive terminal being inaccessible when the first cartridge subassembly is attached to the second cartridge subassembly.

DETAILED DESCRIPTION

The following detailed description of preferred embodiments refers to the accompanying drawings which illustrate specific embodiments of the invention. Other embodiments having different structures and operations do not depart from the scope of the present invention.

Figure 1:
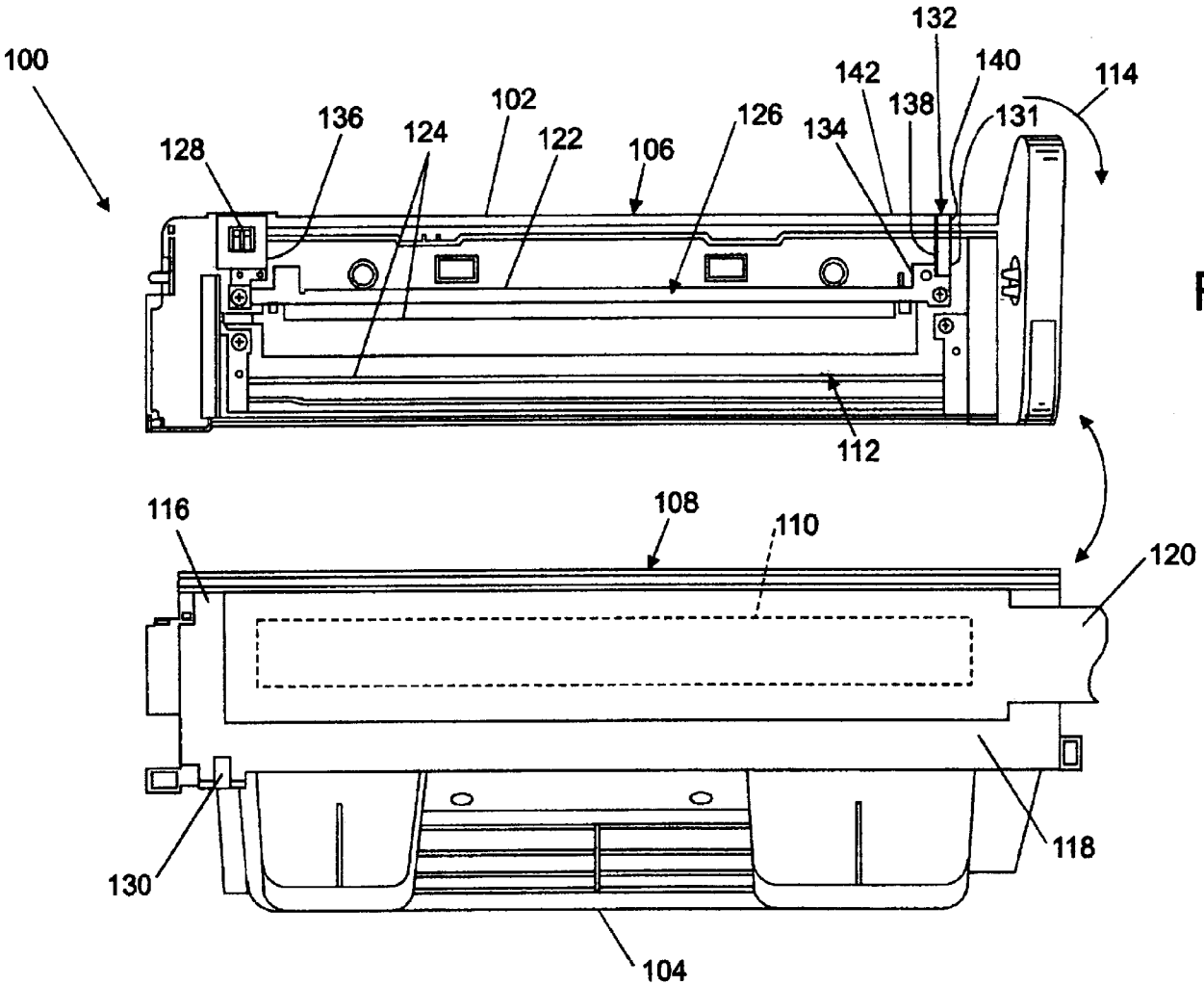
FIG. 1 is an exploded view of an example of an unassembled printer cartridge in accordance with an embodiment of the present invention.

FIG. 1 is an exploded view of an example of an unassembled printer cartridge 100 in accordance with an embodiment of the present invention. The printer cartridge 100 may be a laser printer toner cartridge, such as an HP 4100 laser printer toner cartridge as manufactured by Hewlett-Packard or the like. The printer cartridge 100 may include a first printer cartridge subassembly or developer roller subassembly 102 and a second printer cartridge subassembly or toner hopper subassembly 104. An operative face 106 of the developer roller subassembly 102 is shown in FIG. 1 and a hopper opening face 108 of the toner hopper subassembly 104 is also shown in FIG. 1. The toner hopper subassembly 104 may contain toner (not shown in FIG. 1) and may include a discharge opening 110 (illustrated by a broken line in FIG. 1) through which toner may pass to the developer roller subassembly 102 or the first cartridge subassembly. The developer roller subassembly 102 may include a corresponding opening 112 that mates with the toner hopper discharge opening 110 when the developer roller subassembly 102 is assembled in operative position with the toner hopper subassembly 104. In assembling the printer cartridge 100, the operative face 106 of the developer roller subassembly 102 may be matingly placed in operative position with the opening face 108 such that the discharge opening 110 in the toner hopper subassembly 104 may align with the corresponding opening 112 in the developer roller subassembly 102. The developer roller subassembly 102 may be rotated in a direction illustrated by arrow 114 in FIG. 1 to a position where the operative face 106 of the developer roller subassembly 102 faces the opening face 108 of the toner hopper subassembly 104. The faces 106 and 108 may then be placed in abutment with one another.

The discharge opening 110 may be substantially completely surrounded by a resilient seal 116 that may be attached to a toner hopper sealing surface 118 by an adhesive or the like. The resilient seal 116 may be a rubberized foam type material or similar material to provide a hermetic seal.

The seal 116 permits a closed seal around the discharge opening 110 and corresponding opening 112 in the developer roller subassembly 102 to prevent toner from migrating from the toner hopper subassembly 104 to other portions of the cartridge 100. A removable packaging seal 120 may also be attached by an adhesive or the like to the resilient seal 116 and over the toner discharge opening 110. The removable packaging seal 120 retains the toner in the toner hopper subassembly 104 and may be stripped away or removed by an end user when installing the cartridge 100 in a printer (not shown in FIG. 1).

A first sensing bar 122 and a second sensing bar or bars 124 may be attached to the developer roller subassembly 102. The first sensing bar 122 and the second sensing bar 124 may extend substantially parallel to one another and substantially completely across the corresponding toner discharge opening 112 in the developer roller subassembly 102. The first sensing bar 122 and the second sensing bar 124 may be formed from a conductive material such as copper, aluminum, an alloy or similar electrically conductive material. The first and second sensing bars 122 and 124 may form a portion of a capacitor type device 126 that may be used to sense a toner level or other operating parameters of the printer cartridge 100. A magnetic developer roller 127 (FIG. 2) may also form part of the capacitor type device 126 or another capacitor device or the like to sense toner level or other operating parameters of the printer cartridge 100. A printer (not shown in FIG. 1) in which the printer cartridge 100 is installed may sense a change in capacitance signal across the capacitor type device 126 and may generate an electrical signal corresponding to a level of toner in the toner hopper subassembly 104. A message indicating the toner level may be displayed on a display of the printer or on a user's computer monitor (not shown in FIG. 1) in response to the electrical signal from the capacitor device 126.

The first sensing bar 122 may be connected to one or more first conductive contacts or terminals 128 on the developer roller subassembly 102. At least one second contact or terminal 130 may be attached to the toner hopper subassembly 104. The first and second contacts or terminals 128 and 130 may be made from copper, aluminum or the like. The first conductive terminals 128 normally electrically couple to or contact the second conductive terminal 130 when the developer roller subassembly 102 is assembled in an operative position with the toner hopper subassembly 104 to form the printer cartridge 100. The first conductive terminals may be flexible to provide a good electrical contact to the second conductive terminals 130. The first conductive terminals 128 may be inaccessible when the developer roller subassembly 102 is assembled with the toner hopper subassembly 104, while the second conductive terminal 130 may be exposed or accessible when the developer roller subassembly 102 is assembled with the toner hopper subassembly 104. The first conductive terminals 128 may become bent or damaged during the disassembly and reassembly of the printer cartridge 100 during refurbishing, such that the first terminals 128 may become misaligned and may not properly contact or couple to the second terminal 130 on the toner hopper subassembly 130. The thickness of the resilient seal 116 may also prevent the first and second terminals or contacts 128 and 130 from electrically contacting one another properly. If the first and second terminals 128 and 130 do not contact one another or if the connection is faulty, the capacitor device 126 may not function properly or at all to generate a signal corresponding to the toner level or other operating parameter. Because the first terminals 128 may be inaccessible after reconnecting the developer roller subassembly 102 and the toner hopper subassembly 104, testing the continuity or electrical contact between the first and second terminals 128 and 130 directly may not be possible.

Figure 2:
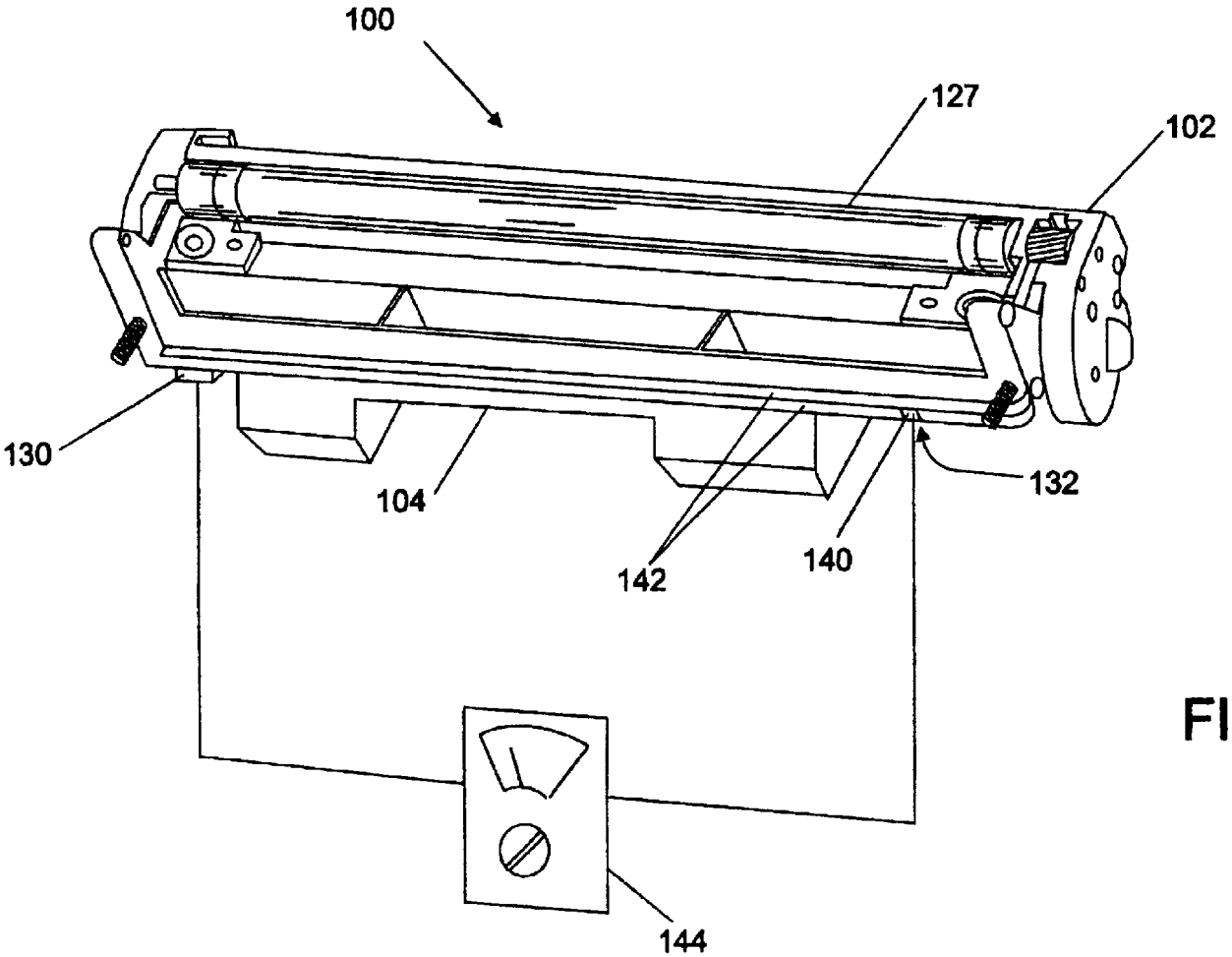
FIG. 2 is a perspective view of an example of an assembled printer cartridge in accordance with an embodiment of the present invention.

A first portion 131 of a conductive strip 132 or the like may be attached to the first sensing bar 122 proximate to an end 134 of the opening 112 in the developer roller subassembly 102 opposite to an end 136 where the first terminals 128 are attached to the developer roller subassembly 102. The conductive strip 132 may be a dead-soft aluminum strip with a thickness of about 2 mils and may be attached to the first sensing bar 122 and the roller developer subassembly 102 by a conductive acrylic adhesive 138 or similar means to hold the conductive strip 132 in place during assembly. The conductive strip 132 or tape may be a Compac #812 aluminum foil tape with a conductive adhesive or the like. The strip 132 may also be made from other conductive materials such as copper, an alloy or the like. The total thickness of the strip 132 with the adhesive 138 may be about 4 mils or less. The strip 132 may be about 0.25 inches wide and about 1.375 inches long and may be placed clear of the openings 112 and 110 so as to not interfere with the discharge of toner when the cartridge 100 is in use. The dimensions of the conductive strip 132 may vary as a function of the structure and dimensions of the particular printer cartridge 100. The conductive strip 132 may be sized to not interfere with the normal operation of the printer cartridge 100 when in use. A second portion 140 of the conductive strip 132 may extend at least to an outer edge 142 of the developer roller subassembly 102 and may be folded over the outer edge 142 as best shown in FIG. 2. FIG. 2 shows the assembled printer cartridge 100 with the second portion 140 of the conductive strip 132 exposed and accessible for testing the continuity or connection between the first terminals 128 (FIG. 1) and the second terminal 130 that may also be exposed and accessible after the printer cartridge 100 is assembled as shown in FIG. 2. A multimeter 144 may be connected between the conductive strip 132 and the exposed portion of the second terminal 130 to measure the continuity. Accordingly, the conductive strip 132 provides an external access to the first contacts or terminals 128 which are inaccessible after the printer cartridge 100 is assembled. Although the present invention has been described with respect to using a conductive strip 132, any device or arrangement that may provide access to an inaccessible contact or terminal after the cartridge 100 is assembled may be used.

Although specific embodiments have been illustrated and described herein, those of ordinary skill in the art appreciate that any arrangement which is calculated to achieve the same purpose may be substituted for the specific embodiments shown and that the invention has other applications in other environments. For example, the structure and method of the present invention may be used to provide access to any internal contacts or terminals within a printer cartridge or the like for testing or for other purposes and may be applicable to originally manufactured cartridges or the like. This application is intended to cover any adaptations or variations of the present invention. The following claims are in no way intended to limit the scope of the invention to the specific embodiments described herein.

What is claimed is:

1. A method of making a printer cartridge, comprising:

assembling a first cartridge subassembly and a second cartridge subassembly, wherein the first cartridge subassembly includes a first conductive terminal and the second cartridge subassembly includes a second conductive terminal that is normally in electrical contact with the first conductive terminal when the first and second subassemblies are assembled;

coupling a conductive strip to the first conductive terminal, the first conductive terminal being inaccessible after the step of assembling; and exposing a portion of the conductive strip externally to the printer cartridge when the first and second subassemblies are assembled.

2. The method of claim 1, wherein the first cartridge subassembly comprises a developer roller subassembly and wherein coupling the conductive strip to the first conductive terminal comprises attaching the conductive strip to a sensing bar of the developer roller subassembly, wherein the sensing bar is connected to the first conductive terminal.

3. The method of claim 1, wherein the conductive strip is formed from one of aluminum, copper or an alloy.

4. The method of claim 1, wherein the conductive strip has a thickness of about 2 mils or less.

5. The method of claim 1, wherein the conductive strip comprises:

a dead-soft aluminum strip; and a conductive acrylic adhesive applied to the strip.

6. The method of claim 1, wherein the second cartridge subassembly is a toner hopper subassembly.

7. The method of claim 6, further comprising coupling the at least first conductive terminal and the at least second conductive terminal to a capacitor device to generate a signal responsive to a level of toner in the toner hopper subassembly.

8. The method of claim 1 further comprising measuring a continuity between the conductive strip and the second conductive terminal.

9. A method of making a printer cartridge, comprising:

attaching a conductive strip on one of a first printer cartridge subassembly or a second printer cartridge subassembly;

assembling the first cartridge subassembly in operative position with the second cartridge subassembly, wherein the first cartridge subassembly includes at least a first conductive terminal and the second cartridge subassembly includes at least a second conductive terminal that normally electrically contacts the at least first conductive terminal after the step of assembling and wherein the at least first conductive terminal is inaccessible and the at least second conductive terminal is accessible after the step of assembling;

wherein the step of assembling further comprises the substep of coupling a first portion of the conductive strip to the at least first conductive terminal; and wherein the step of assembling further comprises the substep of exposing a second portion of the conductive strip external to the first and second cartridge subassemblies.

10. The method of claim 9, wherein attaching the conductive strip comprises attaching the conductive strip to a sensing bar, wherein the sensing bar is connected to the at least first conductive terminal.

11. The method of claim 9, wherein the first and second conductive terminals are located proximate to one end of the first and second printer cartridge assemblies and wherein the step of attaching the conductive strip further comprises the substep attaching the conductive strip proximate to an end of the first or second printer cartridge subassemblies opposite to the one end.

12. The method of claim 9, wherein the conductive strip comprises:

a dead-soft aluminum strip; and a conductive acrylic adhesive applied to the strip.

13. A method of making a printer cartridge, comprising:

attaching a conductive strip to a sensing bar of a developer roller subassembly of the printer cartridge, wherein the sensing bar is electrically connected to at least a first conductive terminal;

assembling the developer roller subassembly in operative position with a toner hopper subassembly to form the printer cartridge, wherein the toner hopper subassembly includes at least a second conductive terminal that normally electrically contacts the at least first conductive terminal after the step of assembling and wherein the at least first conductive terminal is inaccessible after the step of assembling and the at least second conductive terminal is accessible after the step of assembling; and exposing a portion of the conductive strip after forming the printer cartridge.

14. The method of claim 13, further comprising measuring an electrical continuity between the at least first conductive terminal and the at least second conductive terminal by measuring electrical continuity between the conductive strip and the at least second conductive terminal.

15. The method of claim 13, wherein attaching the conductive strip to the sensing bar comprises attaching with a conductive adhesive.

16. A printer cartridge, comprising:

a first cartridge subassembly;

a second cartridge subassembly attached to the first cartridge subassembly, wherein the first cartridge subassembly includes a first conductive terminal and the second cartridge subassembly includes a second conductive terminal that is normally in electrical contact with the first conductive terminal when the first and second subassemblies are attached, and an external access member coupled to the first conductive terminal, the first conductive terminal being inaccessible when the first cartridge subassembly is attached to the second cartridge subassembly, wherein the external access member comprises a conductive strip coupled to the first conductive terminal and wherein the conductive strip includes a portion exposed externally to the printer cartridge when the first and second subassemblies are attached.

17. The printer cartridge of claim 16, wherein the conductive strip has a thickness of about 2 mils or less.

18. The printer cartridge of claim 16, wherein the conductive strip comprises;

a dead-soft aluminum strip; and a conductive acrylic applied to the strip.

19. The printer cartridge of claim 16, further comprising a capacitor device coupled to the first conductive terminal and the second conductive terminal to provide a signal responsive to a level of toner in the printer cartridge.

* * * * *